US006790139B2

(12) United States Patent
Walker et al.

(10) Patent No.: US 6,790,139 B2
(45) **Date of Patent: *Sep. 14, 2004**

(54) METHOD AND APPARATUS FOR SECURING A COMPUTER-BASED GAME OF CHANCE

(75) Inventors: Jay S. Walker, Ridgefield, CT (US); Bruce Schneier, Minneapolis, MN (US); James A. Jorasch, Stamford, CT (US); Andrew S. Van Luchene, Norwalk, CT (US)

(73) Assignee: Walker Digital, LLC, Stamford, CT (US)

( * ) Notice: Subject to any disclaimer, the term of this patent is extended or adjusted under 35 U.S.C. 154(b) by 83 days.

This patent is subject to a terminal disclaimer.

(21) Appl. No.: 09/765,165

(22) Filed: Jan. 18, 2001

(65) Prior Publication Data

US 2001/0008842 A1 Jul. 19, 2001

Related U.S. Application Data

(63) Continuation of application No. 08/888,049, filed on Jul. 3, 1997, now Pat. No. 6,203,427.

(51) Int. Cl.[7] ..... A63F 9/24
(52) U.S. Cl. ..... 463/16; 463/42
(58) Field of Search ..... 463/1, 10–13, 463/16–22, 25, 29, 40–43; 273/138.1, 138.2, 139, 269, 143 R; 380/251; 713/150, 171, 179

(56) References Cited

U.S. PATENT DOCUMENTS

| | | | | |
|---|---|---|---|---|
| 4,309,569 A | | 1/1982 | Merkle | 178/22.08 |
| 4,494,197 A | * | 1/1985 | Troy et al. | 463/18 |
| 4,652,998 A | | 3/1987 | Koza et al. | 364/412 |
| 5,269,521 A | | 12/1993 | Rossides | 273/138 R |
| 5,297,206 A | | 3/1994 | Orton | 380/30 |
| 5,326,104 A | | 7/1994 | Pease et al. | 273/138 A |
| 5,505,449 A | | 4/1996 | Eberhardt et al. | 273/138 A |
| 5,547,202 A | | 8/1996 | Tsumura | 463/29 |
| 5,557,518 A | | 9/1996 | Rosen | 364/408 |
| 5,569,082 A | | 10/1996 | Kaye | 463/17 |
| 5,586,937 A | | 12/1996 | Menashe | 463/41 |

(List continued on next page.)

FOREIGN PATENT DOCUMENTS

| | | |
|---|---|---|
| EP | 0 742 524 A2 | 11/1996 |
| WO | WO 80/02512 | 11/1980 |
| WO | WO 97/19537 | 5/1997 |
| WO | WO 97/22191 | 6/1997 |

OTHER PUBLICATIONS

"Interlotto Lichtenstein Lottery", (http //www2 nis za/cyber/lotto htm), download date: Apr. 25, 1997.

PCT International Search Report for Application No. PCT/US98/13909, mailing date: Aug. 29, 2001.

*Primary Examiner*—Kim Nguyen
(74) *Attorney, Agent, or Firm*—Steven M. Santisi; Michael D. Downs

(57) ABSTRACT

A system is described for facilitating an Internet-based game of chance, particularly a computer-based version of a punchboard game having a grid with prizes associated with the various grid locations. The user can pay a central controller for each selection by providing a credit card number, or through other Internet transaction means. The central controller sends the user a fresh virtual punchboard (i.e. a game in which no selections have yet been made). The user selects a grid location, encrypts it, and then transmits it to the central controller. The central controller then generates prize values for the grid that it sent to the player. The user's computer stores the locations of each prize and determines whether the player's selection was a winner. If he has won, the player sends the decryption key to the central controller to decrypt his grid selection and authenticate his selection. The central controller then initiates a payment to the user.

25 Claims, 27 Drawing Sheets

U.S. PATENT DOCUMENTS

| | | | | | |
|---|---|---|---|---|---|
| 5,674,128 | A | * | 10/1997 | Holch et al. | 463/42 |
| 5,709,603 | A | | 1/1998 | Kaye | 463/17 |
| 5,779,545 | A | * | 7/1998 | Berg et al. | 463/22 |
| 5,836,816 | A | | 11/1998 | Bruin et al. | 463/16 |
| 5,871,398 | A | | 2/1999 | Schneier et al. | 463/16 |
| 5,954,582 | A | | 9/1999 | Zach | 463/25 |
| 5,970,143 | A | | 10/1999 | Schneier et al. | 380/23 |
| 6,024,640 | A | | 2/2000 | Walker et al. | 463/17 |
| 6,030,288 | A | | 2/2000 | Davis et al. | 463/29 |
| 6,203,427 | B1 | | 3/2001 | Walker et al. | 463/16 |

* cited by examiner

211

| CUSTOMER NAME 701 | CUSTOMER ID NUMBER 702 | CREDIT CARD NUMBER 703 | CUSTOMER E-MAIL ADDRESS 704 | CUSTOMER ADDRESSS 705 | TOTAL MONEY SPENT 706 | TOTAL MONEY AWARDED 707 | SELECTION PREFERENCES 708 | PRIZE AWARD PAYMENT PREFERENCE 709 |
|---|---|---|---|---|---|---|---|---|
| BILL SMITH | 4588 | 6465 4645 6546 5648 | SMITH@ AOL.COM | 4 RED ST. | $75 | $100 | J8 | CHECK BY MAIL |
| ANGEL STAR | 4544 | 6546 5465 4688 4589 | ANGEL@ UNIVERSITY.EDU | 6 BLUE RD. | $15 | $0 | A4,B4,C4,D4 | TRANSFER TO CREDIT CARD ACCOUNT |
| JOE BEAD | 4321 | 0103 1831 8555 1215 | JBAED@ WIDGET.COM | 87 PINK LN. | $36 | $350 | NONE | CHECK BY MAIL |

FIG. 7A

214

| PRIZE DISTRIBUTION IDENTIFICATION NUMBER 711 | GRID SIZE 712 | DENOMINATION 713 | PRIZE ALLOCATION 714 |
|---|---|---|---|
| 001 | 10X10 | $1.00 | $50, $5, $10, $25, $50, $100, $25, $5 |
| 002 | 20X30 | $3.00 | $5, $10, $25, 50$, $50, $100, $100, $250 |
| 003 | 30X30 | $5.00 | $100, $25, $50, $100, $100, $250, $500, $5 |
| 004 | 30X30 | $5.00 | $1,000, $500, $500, $250, $250, $100, $100, $100, $50, $50, $50, $25, $15, $15, $5, $5 |

FIG. 7B

311

| GAME IDENTIFICATION NUMBER 901 | SELECTED GRID LOCATION 902 | WINNING GRID LOCATIONS 903 | DENOMINATION 713 | PLAYER KEY 904 |
|---|---|---|---|---|
| 6465484564 | J8 | A4 $5, B1 $10, C10 $25, E7 $50, F2 $50, J8 $100, J9 $100, K5 $250 | $3.00 | 11000101011010 01101101011... |
| 6465486546 | A4,I2,K1 | A5 $100, D7 $25, E8 $25, E9 $100, F7 $100, G3 $250, G6 $500, G7 $5 | $5.00 | 1100011001111 01011010101... |
| 6214563168 | | A1 $50, C7 $5, B7 $10, E9 $50, F1 $100, G4 $25, G9 $5, H1 $25 | $1.00 | |
| | | | $3.00 | |

FIG. 9A

212

| GAME IDENTIFICATION NUMBER 901 | CUSTOMER ID NUMBER 702 | WINNING GRID LOCATIONS 903 | ENCRYPTED GRID LOCATION 910 | DECRYPTED GRID LOCATION 920 | PLAYER KEY 904 |
|---|---|---|---|---|---|
| 6465484564 | 4588 | A4 $5, B1 $10, C10 $25, E7 $50, J8 $100, J9 $100, K5 $250 | AS498DF... | J8 | 10101010 1111011... |
| 6465484565 | 4544 | A2 $5, B3 $10, B4 $100, D6 $250, D7 $25, E2 $50 G1 $50 | ADSFU90A 8FLDJ0D... | | |
| | 4321 | A9 $100,C5 $50, D1 $100, E9 $25, F5 $25,G4 $50, G8 $25, H1 $250 | | | |
| | | A8 $25,B3 $50, C1 $5, D2 $10, G4 $100,H6 $250, J11 $25, K3 $100 | | | |

FIG. 9B

311

| GAME IDENTIFICATION NUMBER 901 | SELECTED GRID LOCATION 902 | WINNING GRID LOCATIONS 903 | DENOMINATION 713 | HASH OF WINNING GRID LOCATIONS 1101 |
|---|---|---|---|---|
| 6465484564 | J8 | A4 $5, B1 $10, C10 $25, E7 $50, F2 $50, J8 $100, J9 $100, K5 $250 | $3.00 | 101000011101<br>1011010111... |
| 6465486546 | A4,I2,K1 | | $5.00 | 101010111110<br>1011011010 1... |
| 6215467168 | | | $1.00 | 101001101011<br>1010110101 1... |
| 6215463175 | | | $3.00 | |

FIG. 11A

212

| GAME IDENTIFICATION NUMBER 901 | CUSTOMER ID NUMBER 702 | WINNING GRID LOCATIONS 903 | USER GRID SELECTION 902 | HASH OF WINNING GRID LOCATIONS 1101 |
|---|---|---|---|---|
| 6465484564 | 4588 | A4 $5, B1 $10, C10 $25, E7 $50, J8 $100, J9 $100, K5 $250 | J8 | 101000111010... |
| 6465484565 | 4544 | A2 $5, B3 $10, B4 $100, D6 $250, D7 $25, E2 $50 G1 $50 | | 101010111110... |
| 64654845666 | 4321 | A9 $100,C5 $50, D1 $100, E9 $25, F5 $25,G4 $50, G8 $25, H1 $250 | | |
| 64654845667 | | A8 $25,B3 $50, C1 $5, D2 $10, G4 $100,H6 $250, J11 $25, K3 $100 | | |

FIG. 11B

311

| GAME IDENTIFICATION NUMBER 901 | SELECTED GRID LOCATION 902 | WINNING GRID LOCATIONS 903 | DENOMINATION 713 | HASH VALUE OF ALL GRID LOCATIONS 1101 | AGGREGATE HASH VALUE 1301 |
|---|---|---|---|---|---|
| 6465484564 | J8 | A4 $5, B1 $10, C10 $25, E7 $50, F2 $50, J8 $100, J9 $100, K5 $250 | $3.00 | 101000011101 1011010111... | 101001000100 0111101011... |
| 6465486546 | A4,I2,K1 | | $5.00 | 101010111110 10110110101... | |
| 6215467168 | | | $1.00 | 101001101011 10101101011... | |
| 6215463175 | | | $3.00 | | |

FIG. 13A

212

| GAME IDENTIFICATION NUMBER 901 | CUSTOMER ID NUMBER 702 | WINNING GRID LOCATIONS 903 | USER SELECTED GRID LOCATION 902 | HASH VALUE OF ENTIRE GRID 1101 | AGGREGATE HASH VALUE 1301 | DENOMINATION 713 |
|---|---|---|---|---|---|---|
| 6465484564 | 4588 | A4 $5, B1 $10, C10 $25, E7 $50, J8 $100, J9 $100, K5 $250 | J8 | 101000111010... | 101001000100 110011110... | $3.00 |
| 6465484564 | 4589 | A4 $5, B1 $10, C10 $25, E7 $50, J8 $100, J9 $100, K5 $250 | C2 | 101010111110... | 101000001111 101110000... | $3.00 |
| 6465484564 | 3218 | A4 $5, B1 $10, C10 $25, E7 $50, J8 $100, J9 $100, K5 $250 | C12, D13 | 101001101011... | | $3.00 |
| 6465484564 | | A4 $5, B1 $10, C10 $25, E7 $50, J8 $100, J9 $100, K5 $250 | | | | $3.00 |

FIG. 13B

311

| GAME IDENTIFICATION NUMBER 901 | SELECTED GRID LOCATION 902 | DECRYPTED WINNING GRID LOCATIONS 1530 | ENCRYPTED WINNING GRID LOCATIONS 1520 | DENOMINATION 713 | RANDOM KEY 1510 |
|---|---|---|---|---|---|
| 6465484564 | J8 | A4 $5, B1 $10, C10 $25, E7 $50, F2 $50, J8 $100, J9 $100, K5 $250 | 001011010110011 | $3.00 | 1100010101101 00110101011... |
| 6465486546 | A4,I2,K1 | A5 $100, D7 $25, E8 $50, E9 $100, F7 $100, G3 $250, G6 $500, G7 $5 | 101011001100111 | $5.00 | 1100011001111 01011010101... |
| 6215463168 | | A1 $50, C7 $5, B7 $10, E9 $50, F1 $100, G4 $25, G9 $5, H1 $25 | 111011001100111 | $1.00 | |
| | | | | $3.00 | |

FIG. 15A

212

| GAME IDENTIFICATION NUMBER 901 | CUSTOMER ID NUMBER 702 | WINNING GRID LOCATIONS 903 | USER SELECTED GRID LOCATION 902 | RANDOM KEY 1510 | DENOMINATION 713 |
|---|---|---|---|---|---|
| 6465484564 | 4588 | A4 $5, B1 $10, C10 $25, E7 $50, J8 $100, J9 $100, K5 $250 | J8 | 1100010101101 00110101011... | $3.00 |
| 6465484565 | 4544 | A2 $5, B3 $10, B4 $100, D6 $250, D7 $25, E2 $50 G1 $50 | A4,I2,K1 | 1100011001111 01011010101... | $5.00 |
| | 4321 | A9 $100,C5 $50, D1 $100, E9 $25, F5 $25,G4 $50, G8 $25, H1 $250 | | | |
| | | A8 $25,B3 $50, C1 $5, D2 $10, G4 $100,H6 $250, J11 $25, K3 $100 | | | |

FIG. 15B

311

| GAME IDENTIFICATION NUMBER 901 | SELECTED GRID LOCATION 902 | WINNING GRID LOCATIONS 903 | DENOMINATION 713 | CUSTOMER ID NUMBER 702 |
|---|---|---|---|---|
| 6465484564 | J8 | A4 $5, B1 $10, C10 $25, E7 $50, F2 $50, J8 $100, J9 $100, K5 $250 | $1.00 | 4588 |
| 6465486565 | A4,I2,K1 | A5 $100, D7 $25, E8 $50, E9 $100, F7 $100, G3 $100, G6 $250, G7 $5 | $3.00 | 4544 |
| 6465486566 | | A1 $50, C7 $5, B7 $10, E9 $50, F1 $100, G4 $25, G9 $10, H1 $25 | $5.00 | 4321 |

FIG. 17A

212

| GAME IDENTIFICATION NUMBER 901 | SELECTED GRID LOCATION 902 | WINNING GRID LOCATIONS 903 | DENOMINATION 713 | CUSTOMER ID NUMBER 702 |
|---|---|---|---|---|
| 6465484564 | J8 | A4 $5, B1 $10, C10 $25, E7 $50, F2 $50, J8 $100, J9 $100, K5 $250 | $1.00 | 4588 |
| 6465486565 | A4,I2,K1 | A5 $100, D7 $25, E8 $50, E9 $100, F7 $100, G3 $250, G6 $500, G7 $5 | $3.00 | 4544 |
| 6465486566 | | A1 $50, C7 $5, B7 $10, E9 $50, F1 $100, G4 $25, G9 $5, H1 $25 | $5.00 | 4321 |

FIG. 17B

METHOD AND APPARATUS FOR SECURING A COMPUTER-BASED GAME OF CHANCE

CROSS REFERENCE TO RELATED APPLICATIONS

The present application is a continuation of U.S. patent application Ser. No. 08/888,049 filed Jul. 3, 1997, now U.S. Pat. No. 6,203,427.

BACKGROUND OF THE INVENTION

This invention relates to an electronic gambling game in which a player selects from a series of possible outcomes. The player and game provider may interact in a variety of ways, including over the Internet.

A number of well-known gambling games are based on a player selecting from a series of possible outcomes, where the winning outcome is randomly generated using some physical or mechanical device furnished by the game operator. Examples of such games are roulette, slot machines, and bingo. In the classical embodiments of these games, the player sees and/or hears the outcome generated (as in bingo and roulette), or even has a hand in generating the outcome himself (as in slot machines). The player's trust in the fairness of these games (that is, his belief that the outcome is random and that his selection, if a winner, will be honored) is largely based on his personal observation. Similarly, the game operator can use various methods to prevent cheating by a player if the player is personally present; for example, a bingo player claiming to be a winner is required to offer his card for inspection.

A well-known example of an entertainment/gambling device is the "punchboard." A punchboard consists of a board with a square grid of holes. Each hole contains a small rolled-up piece of paper. The player takes a pin and pushes through the board, pushing a selected piece of paper through the other side. This paper is then unrolled by the player to reveal whether or not he has won a prize. In a typical punchboard game, a player pays a small sum (approximately $1) to make a selection; prizes are determined by the size of the board and the fees, and may run hundreds of dollars.

Here, too, the player's confidence in the fairness of the game is largely based on his observation of the board; since he selects a piece of paper and can immediately read the message on it, he can be sure that the paper is not switched or tampered with after he selects it. In addition, by watching a number of plays he can eventually satisfy himself that there are indeed winning locations somewhere on the board. A successful electronic version of a punchboard game (a "virtual punchboard") must offer the player similar assurance that the game is not rigged, and must also prevent cheating the player.

Various forms of electronic games of chance have been available for many years. The way these games are played, however, is changing dramatically with the use of digital computers operating on electronic networks such as the Internet. Players can now connect to a remote server and wager electronically. Rather than traveling to the game (casino, bingo hall, etc.), a player can log into an electronic game and wager from the comfort of his own home. While this remote playing has many advantages, it raises several security issues. In a typical electronic gambling game, the player enters his selection and then learns whether he has won, without observing the winning selection being generated. For example, when playing card games at a casino, a player can observe the dealer shuffle and deal the cards and thus has some confidence that the outcome was generated randomly. In an electronic casino, the shuffling process is typically digitally generated, driven by random number generators which the player cannot see. The player cannot know whether the random number generated is truly random or was selected by the casino to give it an advantage.

Furthermore, a player desiring to play an electronic game remotely (for example, communicating with a game provider on the Internet) must send his selection and receive the winning selection over a communication network. In this instance, both the player and game provider require assurance that the communications are secure and that the game is conducted fairly.

Electronic game providers have tried to increase players' confidence in the legitimacy of games by assuring players that gaming software has not been tampered with. For example, an electronic game provider may allow an independent third party to perform an audit of the software. This is a time-consuming and expensive process, however. With complex software running into the hundreds of thousands of lines of code, it is very difficult to find a few lines of code that alter the randomness of the outcomes. Also, use of an independent, third party auditor shifts the need for trust to another party, and does not guarantee the legitimacy of the game.

Some electronic lottery systems have used methods for securing communications between remote player terminals and a central controller. For example, U.S. Pat. No. 4,652,998 to Koza et al. ("Video Gaming System With Pool Prize Structures") describes cryptographic methods for securing these communications. In games dependent on the use of random numbers, however, simply securing against the transmission of a fraudulent random number does not solve the problem of assuring the player that the game is fairly conducted. Nor does it solve the problem of preventing multiple players from cooperating to gain an advantage over the game provider.

U.S. Pat. No. 5,326,104 to Pease et al. ("Secure Automated Electronic Casino Gaming System") describes a system whereby a number of keno playing devices, all within the same playing area, are connected to a central controller. A player can play a device by inserting a player account card into it which is registered and confirmed by the central controller. Security in this system is directed primarily to ensuring that players will not tamper with the keno terminals, and that employees will not enter false tickets into the system. Apparently it is assumed that the central controller is trusted and will not try to cheat the players.

U.S. Pat. No. 5,569,082 to Kayer ("Personal Computer Lottery Game") describes a game whereby a player can purchase a game piece containing an encrypted code which determines whether the piece is a winning one. The player logs onto a central site, via a PC or a kiosk, and types in the code. The site runs a game which reveals to the player if he is a winner in "an exciting fashion." If the player is a winner, he will be given instructions by the site as to where to pick up his prize. Although the system described in this patent provides encryption to protect the site from fraud, it offers no encryption to protect the player.

U.S. Pat. No. 5,547,202 to Tsumura ("Computer Game Device") describes a system whereby a player can pay for the usage of games transmitted to his PC or to a kiosk via satellite from a central controller. The games are scrambled until payment is made. The central controller can store a game so that a player can take breaks from a game, return to it and continue play from the point in the game at which he left it. This system has neither a gambling element nor is it cryptographically enabled.

U.S. Pat. No. 5,269,521 to Rossides ("Expected Value Payment Method and System For Reducing the Expected Per Unit Costs of Paying and/or Receiving a Given Amount of Commodity") describes a system where a customer exchanges encoded numbers with a product vendor. After being decoded, the two numbers are combined to determine a result. (See column 30, lines 1 to 5, as well as column 30, line 35, to column 31, line 55). The transactions described are not conducted in an online manner. Additionally, both parties must encode their numbers before exchanging them. No game results are ever exchanged in encoded form.

U.S. Pat. No. 4,309,569 to Merkle ("Method of providing digital signatures") describes a system for digital signatures utilizing hash trees.

The proliferation of electronic network technology, along with the ease of user access to networks such as the Internet, has dramatically increased electronic communications and the exchange of information. Among a myriad of other uses, these networks facilitate the playing of games, including gambling activities. They are particularly well suited for such gaming because of their ability to collapse geographic distances while linking distributed players. As discussed above, however, the electronic implementation of games, and particularly gambling activities, often results in the loss of confidence and validity otherwise imbued in players from their personal observation of traditional gaming procedures (for example, dealing cards, spinning roulette wheels, etc.).

There thus exists a need in the art for systems and procedures which can both actually and in the perception of players improve the security and operation of electronic gambling and games. Such systems and procedures would not only foster the perception of on-line gaming as legitimate, but also increase player participation in such activities. This would further increase the commercial value of what is already a substantial online business.

SUMMARY OF THE INVENTION

In accordance with the present invention there is provided a new and improved method and apparatus for facilitating computer-based games of chance on electronic networks such as the Internet. A key feature of the invention comprises the use of encoding techniques, including various encryption schemes, to validate the operation of the games and prevent cheating by either the player or the game provider. Although encryption methods are described, it should be noted that any encoding scheme which prevents the recipient of a message from deciphering its contents will suffice.

In accordance with one embodiment of the invention, a method of generating and verifying the results of a computer-based game of chance is implemented by transmitting to a player computer a plurality of available game selections, each identified by a unique selection identifier. A player selection identifier is received from the player computer, and a winning selection identifier transmitted to the player computer. The player selection identifier and the winning selection identifier are compared to determine if the player has won the game. In accordance with the invention, verification is made that the winning selection identifier and the player selection identifier were independently generated.

Game operation is preferably managed by a central controller, with players communicating with the controller through player computers connected over an electronic network. In different embodiments of the invention, verification of authenticity is provided in the central controller, the player computer, some combination of both, or with the involvement of a third party.

Games supported include all games of chance which permit a user to select from amongst a plurality of potentially winning selections. Applicable games include, but are not limited to a punchboard having punch locations, a roulette wheel having wheel numbers, a bingo game having user-selected card numbers, and a slot machine having user-selectable outcomes.

Verification is provided through a variety of techniques, including the use of encryption such as key-based encryption, and hash-based encryption. The invention further contemplates the use of a third-party trusted agent to monitor and verify that the player and winning selections were independently generated.

BRIEF DESCRIPTION OF THE DRAWINGS

FIG. 7*a* shows in tabular form the fields of the customer database of the central controller.

FIG. 7*b* shows in tabular form the information in the prize distribution database of the central controller.

FIG. 9*a* shows in tabular form the information in the audit database of the user computer according to the first embodiment of the invention.

FIG. 9*b* shows in tabular form the information in the game database of the central controller according to the first embodiment of the invention.

FIG. 11*a* shows in tabular form the information in the audit database of the user computer according to the second embodiment of the invention.

FIG. 11*b* shows in tabular form the information in the game database of the central controller according to the second embodiment of the invention.

FIG. 13*a* shows in tabular form the information in the audit database of the user computer according to the third embodiment of the invention.

FIG. 13*b* shows in tabular form the information in the game database of the central controller according to the third embodiment of the invention.

FIG. 15*a* shows in tabular form the information in the audit database of the user computer according to the fourth embodiment of the invention.

FIG. 15*b* shows in tabular form the information in the game database of the central controller according to the fourth embodiment of the invention.

FIG. 17*a* shows in tabular form the information in the audit database of the third party according to the fifth embodiment of the invention.

FIG. 17*b* shows in tabular form the information in the game database of the central controller according to the fifth embodiment of the invention.

DETAILED DESCRIPTION OF THE PREFERRED EMBODIMENTS

Figure 1:
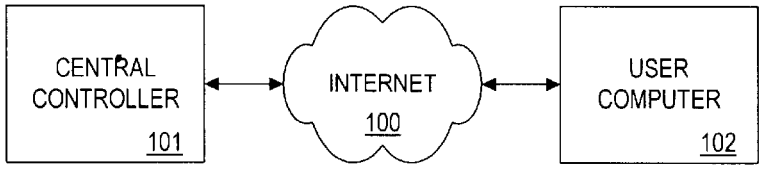
FIG. 1 is a block diagram showing an overview of the system of the present invention.
Figure 2:
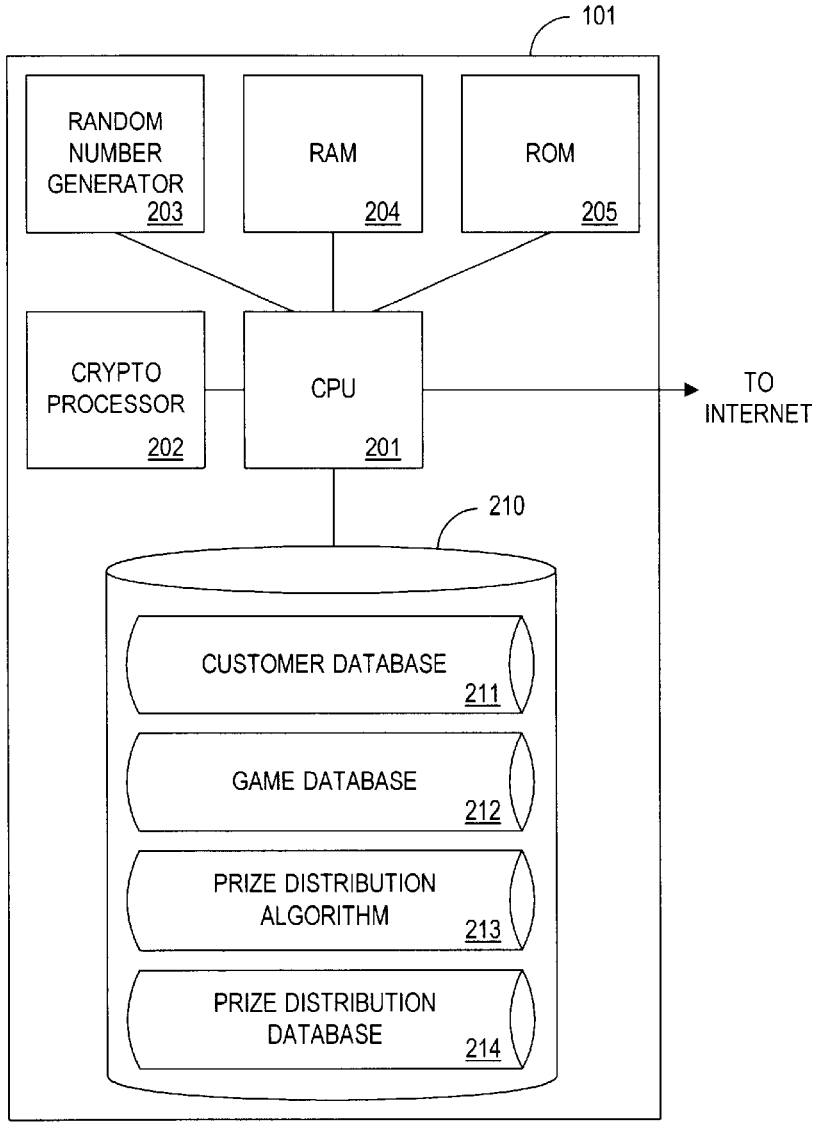
FIG. 2 is a block diagram of the central controller of FIG. 1.

An overview of the system in the preferred embodiments of the present invention is shown in FIG. 1. The central controller 101, operated by the game provider, communicates with the user computer 102 (operated by the game player) over the Internet 100. FIG. 2 is a schematic diagram of the structure of the central controller 101. The central controller includes a CPU 201, connected to a cryptoprocessor 202, a random number generator 203, RAM 204, ROM 205 and a data storage device 210. The CPU 201 connects to the Internet for communication with the player's computer. The data storage device 210 includes a customer database 211, a game database 212, storage for the prize distribution algorithm 213 and a prize distribution database 214. To perform the various functions described in more detail below, the CPU 201 executes a program or programs stored in RAM 204 and/or ROM 205.

Cryptographic processor 202 supports the encoding and decoding of communications with players, as well as the authentication of players. An MC68HC16 microcontroller, commonly manufactured by Motorola Inc., may be used for cryptographic processor 202. This microcontroller utilizes a 16-bit multiply-and-accumulate instruction in the 16 MHZ configuration and requires less than one second to perform a 512-bit private key operation. Other exemplary commercially available specialized cryptographic processors include VLSI Technology's 33 MHz 6868 or Semaphore Communications' 40 MHZ Roadrunner 284. Alternatively, cryptographic processor 202 may be configured as part of CPU 201.

A conventional random number generating processor may be used for random number generator 203. The HEMT integrated circuit manufactured by Fujitsu, for example, is capable of generating over one billion random numbers per second. Alternatively, random number generator 203 may be incorporated into CPU 201. Data storage device 210 may include hard disk, magnetic, or optical storage units, as well as CD-ROM drives or flash memory.

Figure 3:
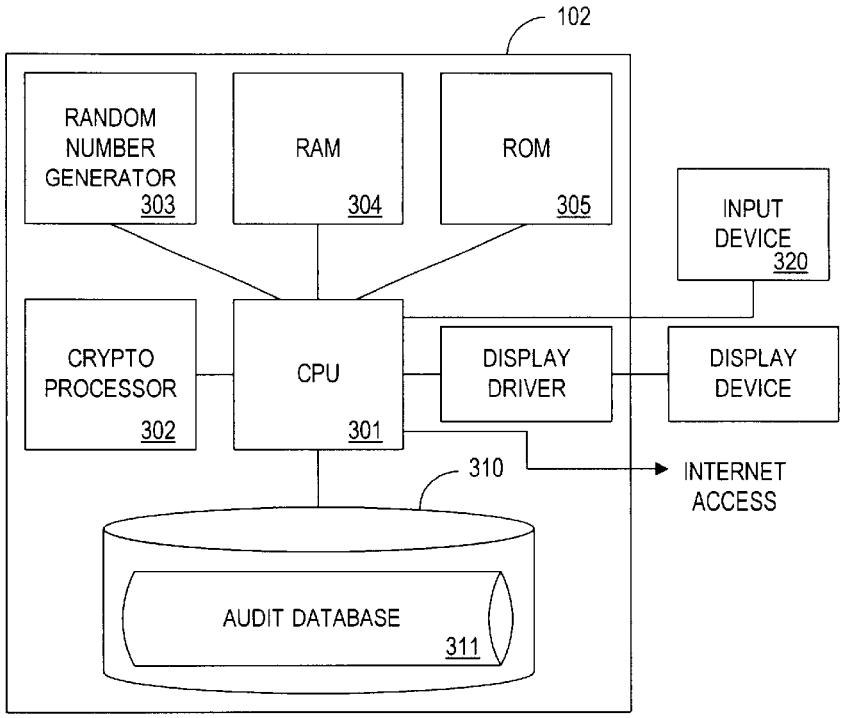
FIG. 3 is a block diagram of the user computer of FIG. 1.

The user computer 102 is shown schematically in FIG. 3. The user computer includes a CPU 301, connected to a cryptoprocessor 302, a random number generator 303, RAM 304, ROM 305 and a data storage device 310. The CPU 301 is also connected to an input device 320 and to the Internet, for communication with the user and the central controller respectively. In addition, the CPU 301 is connected to a display device 330 for displaying a virtual punchboard to the user. The data storage device 310 includes an audit database 311. The CPU 301, cryptoprocessor 302, random number generator 303 and data storage device 310 may have the same features as CPU 201, cryptoprocessor 202, random number generator 203 and data storage device 210 discussed just above.

Figure 4:
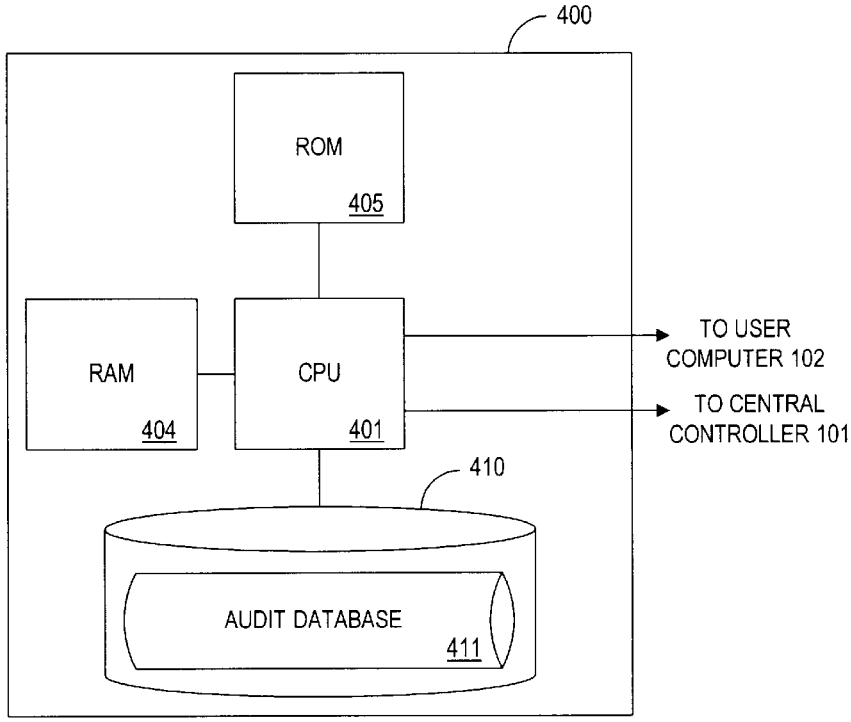
FIG. 4 is a block diagram of a trusted third party computer.

FIG. 4 is a schematic diagram of a trusted third party computer 400, which is used in an embodiment of the invention discussed in more detail below. This computer includes a CPU 401, RAM 404, ROM 405 and data storage device 410, similar to central controller 101 and user computer 102. The data storage device includes an audit database 411. The CPU 401 is connected for communication with the user computer 102 and the central controller 101.

Figure 5:
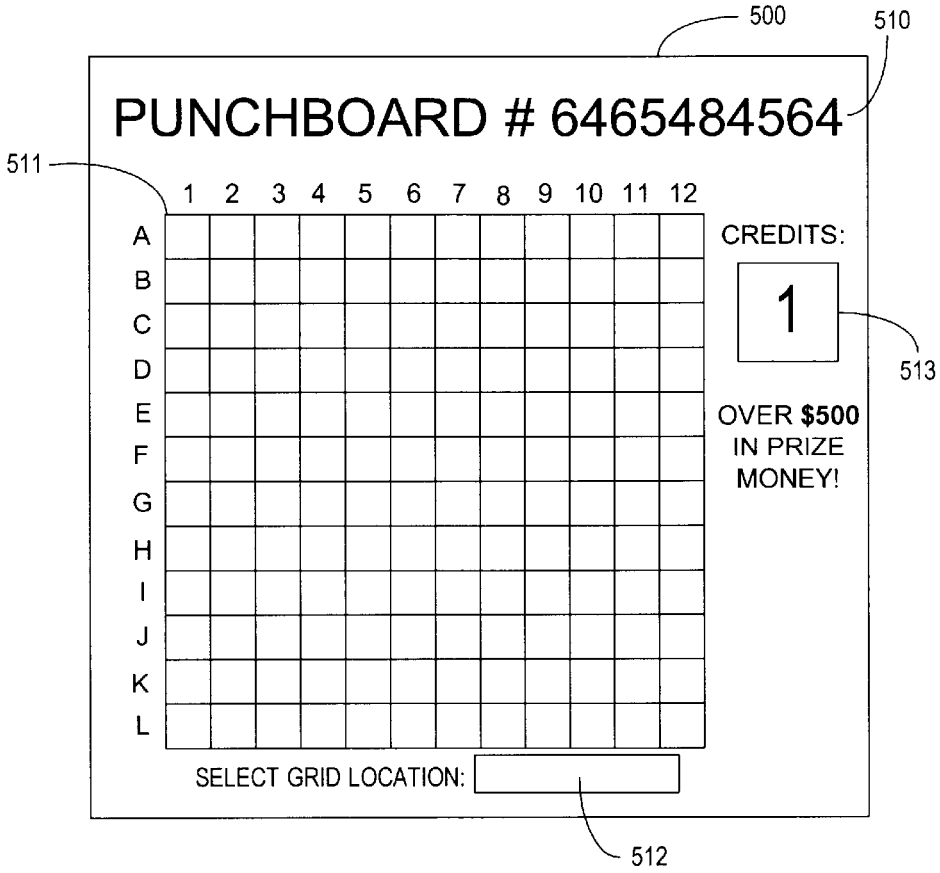
FIG. 5 is a schematic representation of the punchboard game area before a game has been played.

FIG. 5 shows the appearance of a virtual punchboard display 500, displayed to a user on the display device 330, before a game is played. The game is identified by a number 510, and an empty grid 511 is shown (in this case, a 12×12 square). A box 512 appears where the player may enter his selected grid locations. The player's current credits 513 (how much he has paid for the present game, plus his winnings so far) may also be displayed; in the example shown, the player has no winning balance and has just made an electronic payment of $1 to play game #6465484564.

Figure 6:
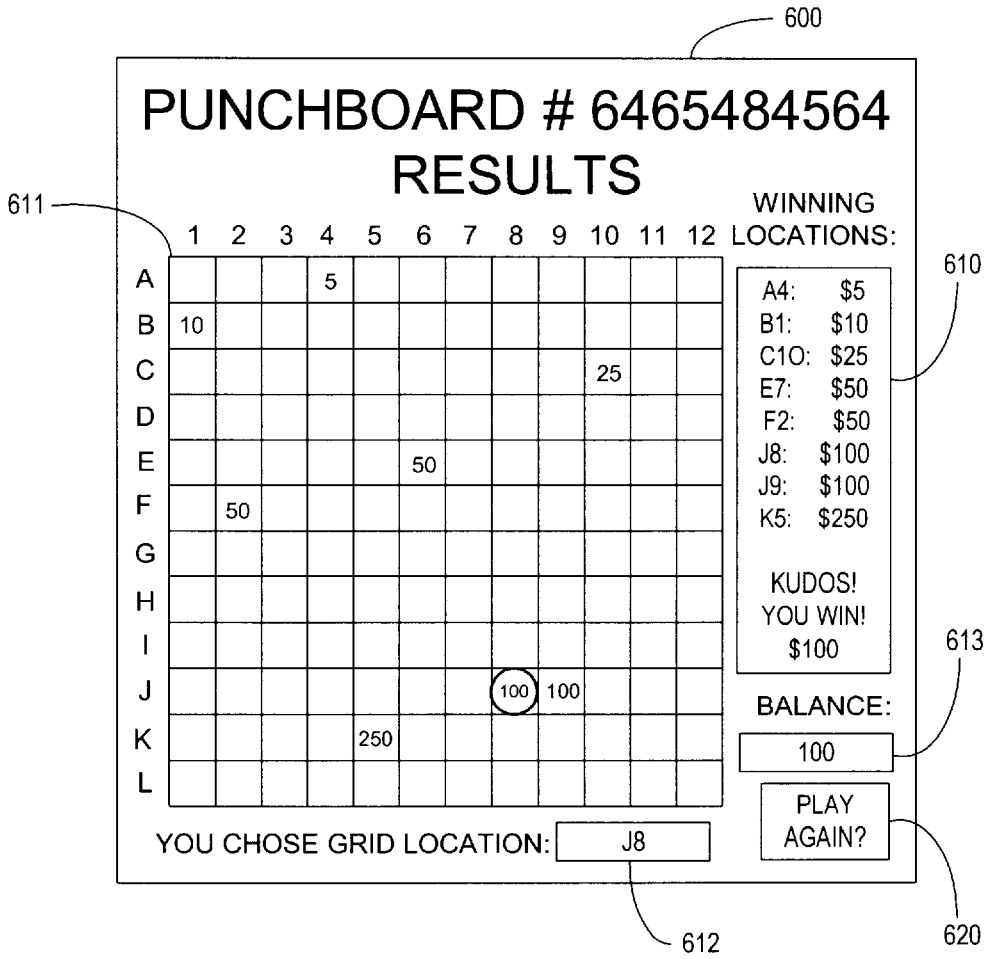
FIG. 6 is a schematic representation of the punchboard game area after a game has been played.

FIG. 6 shows a results display 600, similarly displayed to the user by display device 330, after the game is played. The winning locations are displayed in a table 610 and on the grid 611, with the player's selection circled on the grid and displayed in a box 612. Also displayed is the result of the game (in this case the player is told, "YOU WIN!") and the balance 613 of the player's winnings. Finally, the display includes a box 620 labeled "PLAY AGAIN?" The CPU 301 may advantageously execute interactive display software (stored in RAM 304 or ROM 305) which enables "click boxes" and the like. In that case, the player would click on the "PLAY AGAIN?" box to order a new game.

FIG. 7*a* shows the fields of the customer database 211 maintained by the central controller 101. Each customer is identified by name 701 and is assigned an ID number 702. Each customer entry in the database also includes a credit card number 703, the customer's e-mail address 704 and postal mailing address 705, the total amount the customer has spent 706, and the customer's total winnings to that point 707. The database stores the grid selection preferences 708 for each customer (so that a player who regularly plays the same location on the grid need not enter that location in every game), and the customer's preferred method 709 of receiving his winnings.

The fields of the prize distribution database 214, maintained by the central controller 101, are shown in FIG. 7*b*. Each prize distribution is assigned an identification number 711. Each entry in the database includes the size 712 of the grid, the denomination of the game 713 (that is, the cost to the customer for one play) and the number and amount of prizes 714 to be awarded. Generally, a larger grid has more prizes associated therewith, and a grid with larger prizes has a larger associated denomination.

To create a new game, the central controller 101 employs a prize distribution algorithm 213 having the following steps: The central controller 101 retrieves the prize structure 714 and grid size 712 from the prize distribution database 214 by searching for the prize distribution ID number 711. The CPU 201 instructs the random number generator 203 to produce enough random numbers to cover the number of grid locations for the game. Each random number is appended to a grid location. The format might be (x,y,r), where "x" is the x-coordinate of the grid location, "y" is the y-coordinate of the grid location, and "r" is the assigned random number. The random numbers are then ranked numerically. Prizes are then appended to each grid location. The format might be (x,y,r,p), with "p" the prize value (which may be zero) assigned to the grid location (x,y). The game is then assigned an ID number. The winning grid locations for the game, and the prizes associated with those locations, are then stored in the game database 212, detailed embodiments of which are described below. Those skilled in the art will appreciate that there are many possible algorithms by which the prices may be randomly assigned. The above algorithm is merely illustrative.

First Embodiment (User Computer Encryption)

In the first embodiment of the invention, the fields of the audit database 311 (stored in the user computer 102) are as shown in FIG. 9*a*. Each record in the audit database 311 corresponds to one game played by the user, and is filled in as the game progresses (as described in detail below). A record includes an identification number 901 for the game, the grid location or locations 902 selected by the player, the winning grid locations 903, the game denomination 713, and a random key 904 which the player uses to encrypt his grid location selections.

In this embodiment, the fields of the game database 212 (stored in the central controller 101) are as shown in FIG. 9*b*. Each record in the game database corresponds to one game (having an ID number 901) played by one player (having an ID number 702). Each record includes the winning grid locations 903, the player's selected and encrypted grid location 910, the corresponding decrypted grid location 920, and the player key 904.

Figure 8:
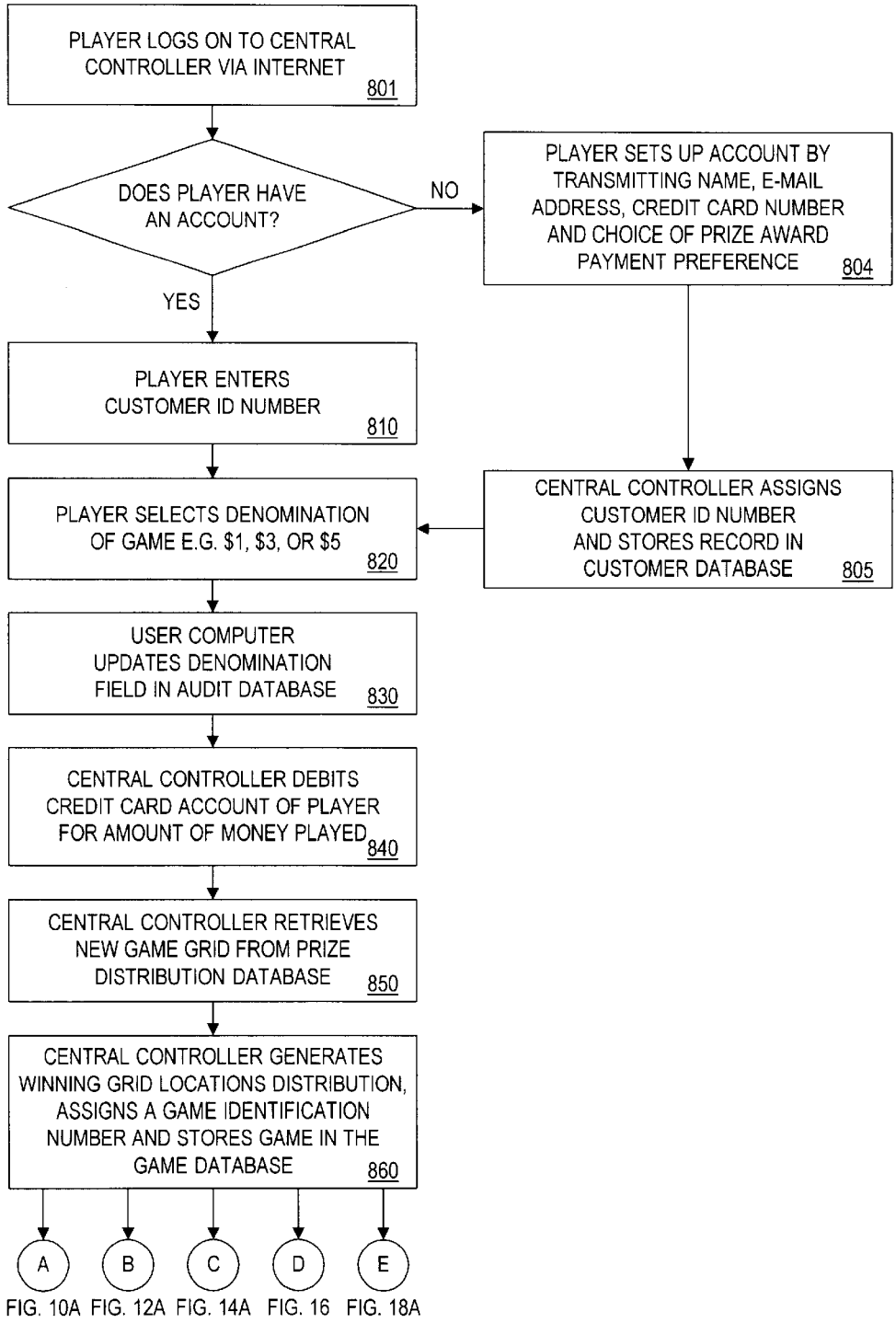
FIG. 8 is a flowchart describing initiation of a game according to the preferred embodiments of the present invention.

A game conducted according to the first embodiment of the invention begins with the steps shown in the flowchart of FIG. 8. Initially, the player (using his computer 102) logs on to the central controller 101 via the Internet 100 (step 801). If the player does not yet have an account (that is, an entry in the customer database 211), an account is opened at this time; the player provides the necessary information (step 804), and the central controller 101 assigns him an ID number and stores the new record in the customer database 211 (step 805). If the player already has an account, he enters his customer ID number 702 (step 810). The player then selects the amount of money he wishes to play—that is, the denomination of the game; for example, $1, $3, or $5 (step 820). The user computer 102 updates the denomination field 713 in the audit database 311 (step 830). The central controller 101 debits the credit card account of the player for the amount of money played (step 840). The central controller 101 retrieves a new game grid from the prize distribution database 214 (step 850). Using the prize distribution algorithm 213 described above, the central controller 101 generates the winning grid locations 903, assigns the game identification number 901 and stores the game in the game database 212 (step 860).

Figure 10A:
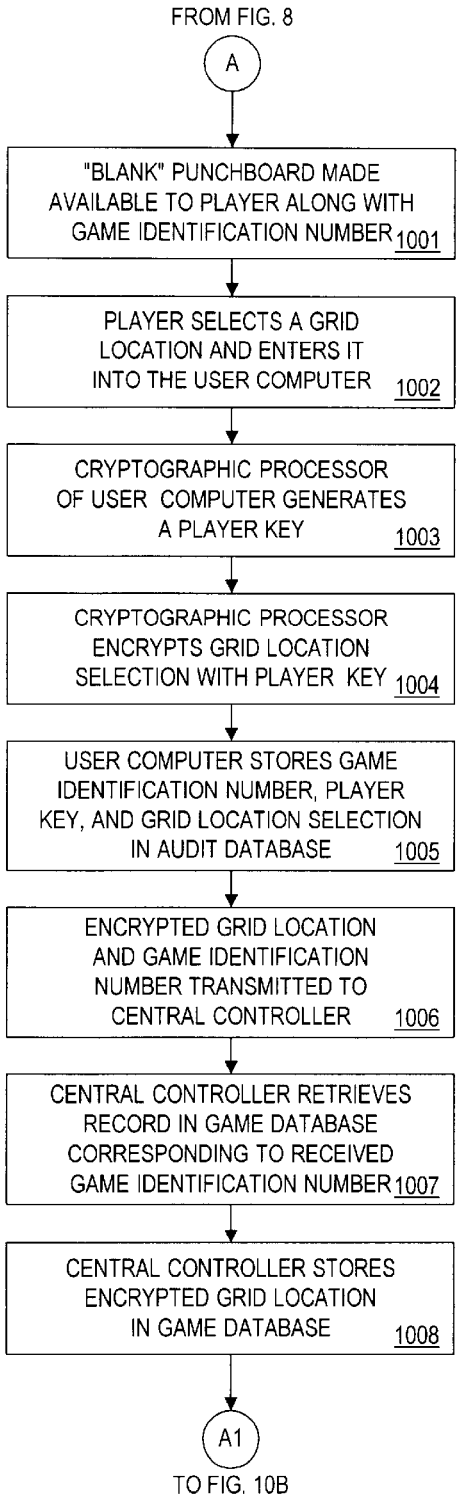
FIGS. 10*a* and 10*b* are connected flowcharts describing the flow of play between the central controller and user computer according to the first embodiment of the invention.
Figure 10B:
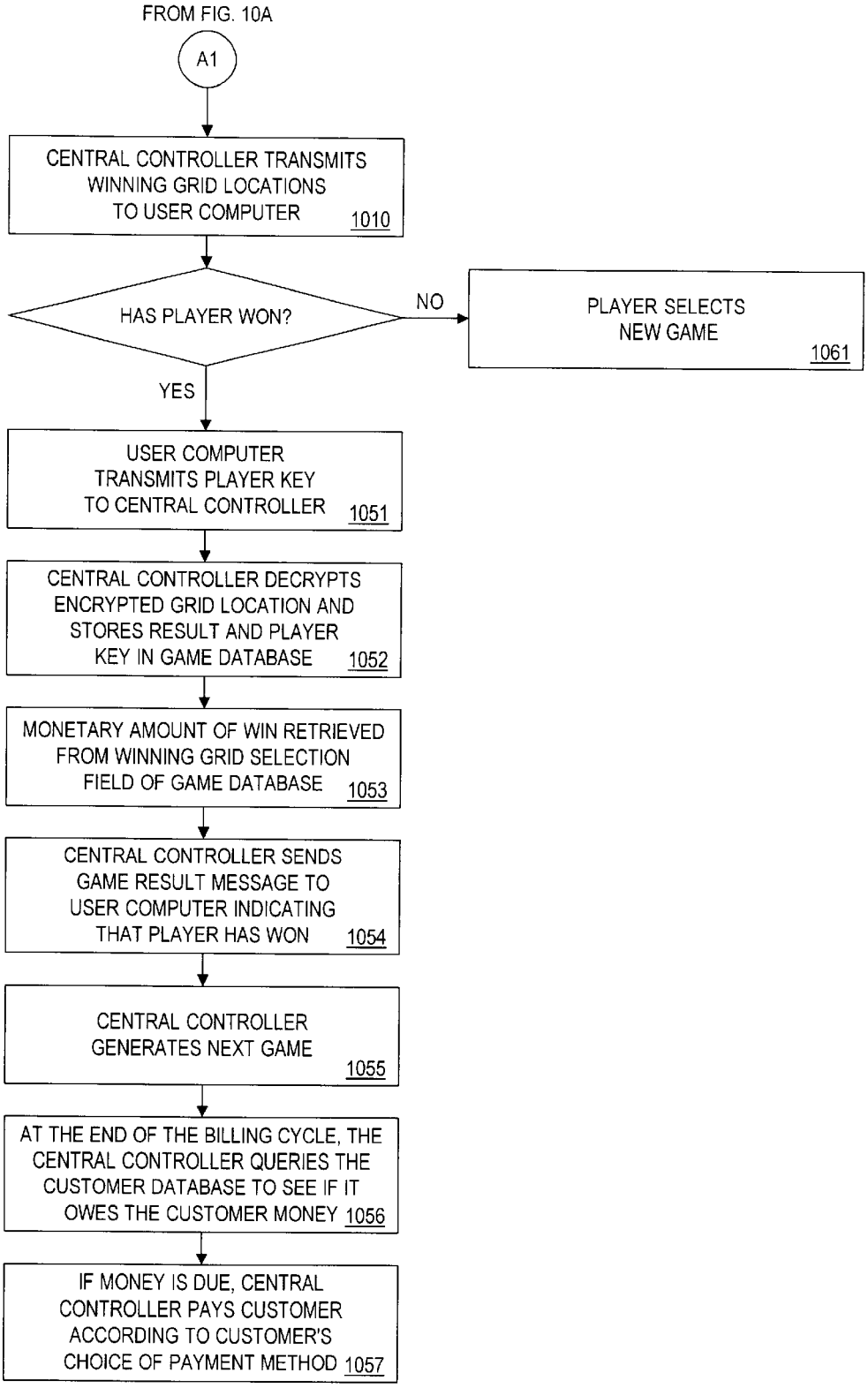

In this embodiment, the game continues with the steps shown in the flowcharts of FIGS. 10*a* and 10*b*. In step 1001 of FIG. 10*a*, a "blank" punchboard 500 including the game identification number 510 is made available to the player. The player selects a grid location 902 and enters it into the user computer 102 using input device 320 (step 1002). The cryptographic processor 302 of the user computer 102 generates a player key 904, preferably based on a random number generated by random number generator 303 (step 1003). The cryptographic processor 302 encrypts the grid location selection 902 with the player key (step 1004). The user computer 102 stores the game identification number, player key, and grid location selection in the audit database 311 (step 1005).

In step 1006, the encrypted grid location and game identification number are transmitted to the central controller 101. The central controller then retrieves the record in the game database 212 corresponding to the game identification number received from the user computer 102 (step 1007). The central controller 101 stores the encrypted grid location 910 in the game database 212 (step 1008).

At this point, the central controller 101 has the player's grid location selection, but only in an encrypted form. The central controller 101 then transmits the winning grid locations 903 to the user computer 102 (step 1010 of FIG. 10*b*).

If the player has not won, he may proceed to select a new game (step 1061). If the player has won, the user computer 102 transmits the player key 904 and game identification number to the central controller 101 (step 1051). The central controller decrypts the encrypted grid location 910, and stores the decryption result 920 (the player's selected, winning grid location) and player key 904 in the game database 212 (step 1052).

The amount of money won by the player is retrieved from winning grid location field 903 of the game database 212 (step 1053). The central controller 101 then sends the game result message 600 to the user computer 102, indicating that the player has won (step 1054). The central controller then proceeds to generate the next game (step 1055).

At the end of the billing cycle, the central controller 101 queries the customer database 211 to see if the customer is owed money (step 1056). If money is due the customer, the central controller 101 initiates a payment to the customer according to the customer's preferred payment method 709 (step 1057).

It should be noted that a key element of this embodiment is that the user sends his grid location selection in encrypted form (thus unreadable by the central controller 101) to the central controller before receiving the winning grid locations. The player is thereby assured that the game provider cannot change the winning locations based upon knowledge of his selection. On the other hand, the central controller holds the player's encrypted selection before the player is given the winning locations, and the player must provide the key to decrypt his selection before the central controller awards him a prize. The encryption of the player's selection thus assures both parties that the game has been fairly conducted, and that the two numbers were independently generated.

A transmission between the central controller and the player may include a digital signature to provide further assurance of the authenticity of the transmission, and to prevent repudiation by the sender. The uses and advantages of digital signatures are discussed generally in Schneier, "Applied Cryptography" (2d ed. 1996), chapter 2.

The above embodiment is also applicable to a game such as roulette. Instead of encoding his grid location selection, the player encrypts his number selection (representing any of the 38 wheel slots). The central controller then transmits the result of the wheel spin to the player.

The game of bingo could be simulated as follows. The player selects a board and then encrypts his selection before sending it to the central controller. The central controller then sends out each bingo number until one of the players claims a win. The winning player sends his key to the central controller so that his selection can be verified.

To simulate a slot machine, the player simply selects one of the possible reel combinations of the slot machine. In a slot machine with three reels and 20 stops per reel, there are 8,000 (20×20×20) possible outcomes, so the player could select one of these at random, encrypting the selection and sending it to the central controller. The central controller then distributes the prizes among the possible outcomes and sends the complete set of outcomes to the player so that he can determine whether or not he has won.

Second Embodiment (One-Way Hash)

In the second embodiment of the invention, the audit database 311 in the user computer 102 has a structure as shown in FIG. 11*a*. As in the first embodiment, each record in the audit database corresponds to one game. A record includes the game identification number 901, selected grid location or locations 902, winning grid locations 903 and the game denomination 713, similar to the record shown in FIG. 9*a*. In this embodiment, the record also includes the hash value 1101 of the winning grid locations 903.

The structure of the game database 212 in this embodiment is shown in FIG. 11*b*. Each entry in the game database has a game identification number 901, a customer identification number 702 and the winning grid locations 903, as in the first embodiment. The entry also has the user-selected grid location 902 and the hash value 1101 of the winning grid locations 903.

Figure 12A:
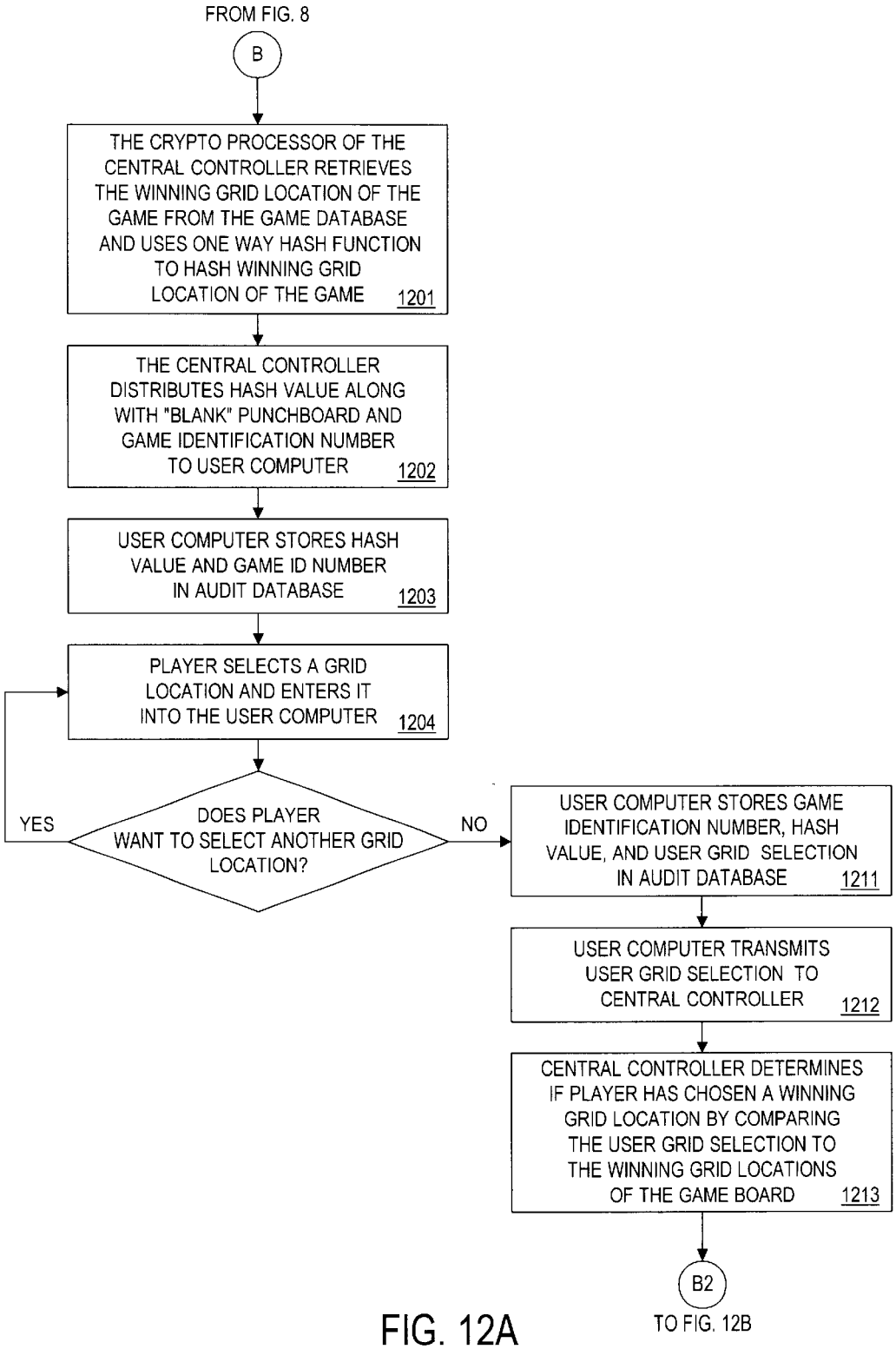
FIGS. 12*a* and 12*b* are connected flowcharts describing the flow of play between the user computer and the central controller according to the second embodiment of the invention.
Figure 12B:
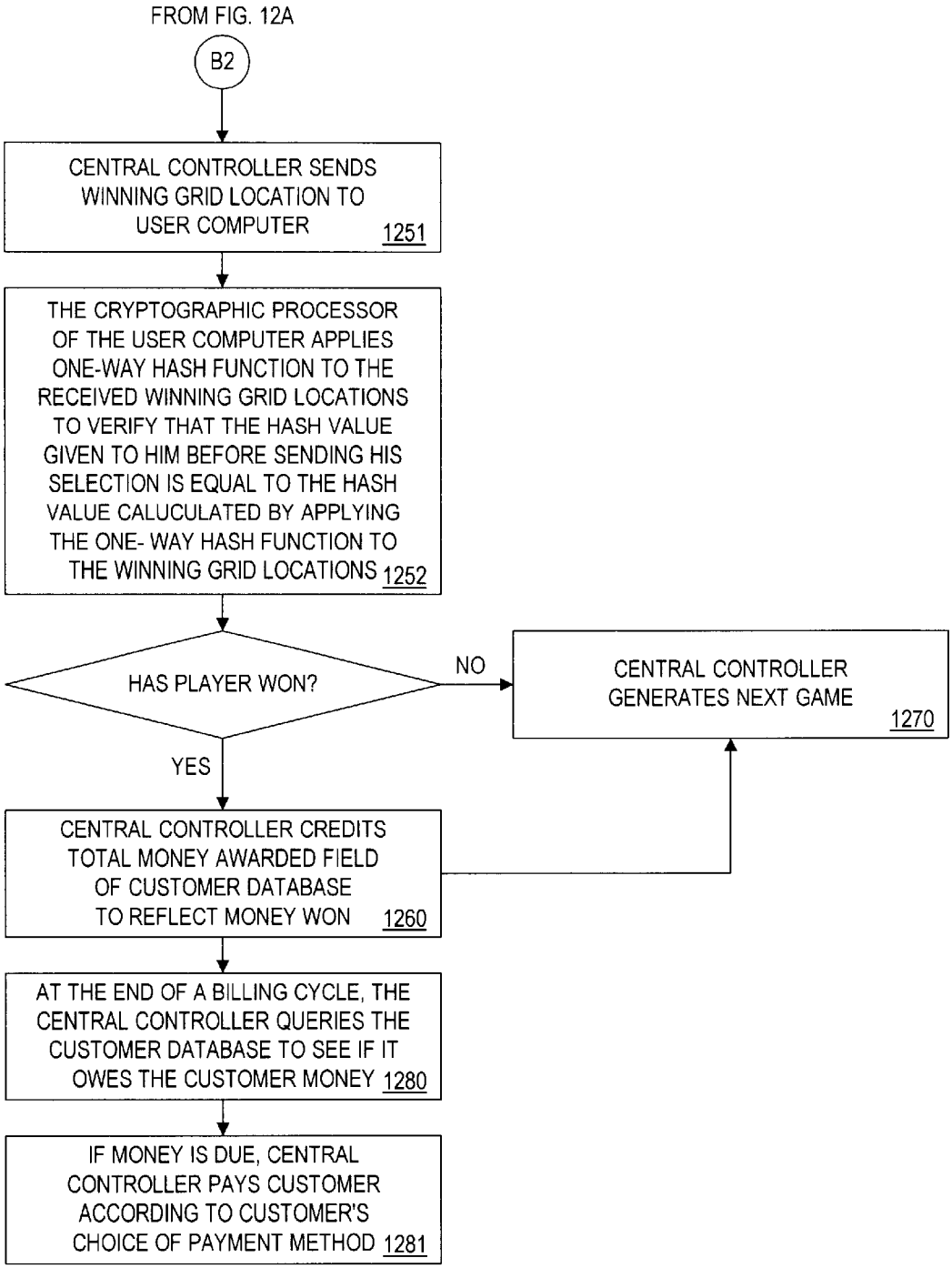

A game conducted according to the second embodiment of the invention begins with the steps shown in the flowchart of FIG. 8 as already described above, and continues with the steps shown in the flowcharts of FIGS. 12*a* and 12*b*. In step 1201 of FIG. 12*a*, the cryptoprocessor 202 of the central controller 101 retrieves the winning grid locations 903 of the game from the game database 212, and uses a one-way hash function to hash the winning grid locations 903, thereby generating the hash value 1101. The hash value 1101 represents a one-way transformation of the winning grid locations 903.

An important feature of the one-way hash function is that it is computationally simple (given the hash function) to generate the hash value, but computationally unfeasible to recreate the winning grid locations from the hash value alone. The hash value 1101 thus serves as a unique identifier for the winning grid locations 903, without the winning grid locations themselves being revealed. Further details on one-way hash functions are given in Schneier, "Applied Cryptography" (2d ed. 1996), chapter 18.

The central controller 101 distributes the hash value 1101 to the user computer 102, along with a "blank" punchboard 500 with game identification number 510 (step 1202). The user computer 102 stores the hash value and game ID number in the audit database 311 (step 1203). In step 1204, the player selects a grid location and enters it into the user computer 102; the player may make additional grid location selections. Once the player has made all of his selections, the user computer 102 stores the game identification number 901, the selected grid locations 902 and the hash value 1101 in the audit database 311 (step 1211). The user computer 102 transmits the selected grid locations 902 to the central controller 101 along with the game ID number (step 1212). It should be noted that at this point the central controller 101 has the player's selections, but has already provided the player with a representation of the winning grid locations in the form of the hash value 1101. In step 1213, the central controller 101 determines whether the player has chosen a winning grid location by comparing the selected locations 902 with the winning grid locations 903 for that game.

Referring now to FIG. 12*b*, the central controller 101 sends the winning grid locations 903 to the user computer 102 (step 1251). In step 1252, the user computer 102 verifies the fairness of the game. Specifically, the cryptographic processor 302 of the user computer 102 applies the one-way hash function to the received winning grid locations to verify that the hash value 1101 given to him before sending his selection is equal to the new hash value calculated by applying the one-way hash function to the winning grid locations.

If the player has not won, the central controller 101 proceeds to generate the next game (step 1270). If the player has won, the central controller 101 updates the total money awarded 707 in the customer database 211 to reflect the amount the player has just won (step 1260), and then generates the next game. In addition, at the end of a billing cycle, the central controller 101 queries the customer database 211 to see if the customer is owed money (step 1280). If money is due the player, the central controller 101 initiates a payment to the customer according to customer's payment method preference 709 (step 1281).

It should be noted that in this embodiment the punchboard cannot be reused; it must be replaced with a fresh punchboard after each player selection. If the punchboard were not replaced, the player could continue to select grid locations after receiving the winning grid locations 903 (see step 1251). The player could, however, make more than one selection during a game session (see step 1204), as long as each selection was received by the central controller 101 before the winning locations were transmitted to the player.

With minor modifications, this embodiment of the invention can accommodate any number of players. By delaying the transmission of the winning grid locations until after all grid location selections have been received, any number of players can be accommodated with one punchboard. Alternatively, games could be conducted at great speed, preventing players from cheating by sharing winning locations. For example, two players might make selections on the same punchboard nearly simultaneously. The first player sends his grid location selection and then receives the winning grid locations. A fraction of a second later the second player sends his grid location selection. If the first player can communicate with the second player he can inform the second player of the winning grid locations, ensuring a win for the second player. If the time difference between the two plays is small enough, however, the first player will not have enough time to communicate the winning locations.

Third Embodiment (Hash Tree)

The third embodiment of the invention uses hash trees to accommodate multiple players in a single punchboard game. Details of hash tree techniques are well known in the art and for reference purposes are discussed in Merkle (U.S. Pat. No. 4,309,569).

In this embodiment, each grid location is represented by $(x,y,p,h_{xy'})$, where x and y are the coordinates, p is the prize associated with that location, $h_{xy}$ is the hash value of that location, and $h_{xy'}$ is an aggregate hash value for all the other locations. Furthermore, a hash value, h, is calculated for the entire grid (including all locations) using hash function H. This function has the property $H(h)=H(h_{xy}, h_{xy'})$ That is, the hash value for the entire grid is equal to the hash value of one location combined with the locations's $h_{xy'}$ value. For additional security, a random number may be attached to each grid location to provide greater variation in the resulting hash values.

In this embodiment of the invention, the audit database 311 in the user computer 102 has a structure as shown in FIG. 13*a*. As in the previous embodiments, each record in the audit database corresponds to one game. A record includes the game identification number 901, selected grid location or locations 902, winning grid locations 903 and the game denomination 713, similar to the records shown in FIGS. 9*a* and 11*a*. In this embodiment, the record also includes the hash value 1101 for all grid locations (both winning and losing), and an aggregate hash value 1301, representing the hash value of the aggregate of all the grid locations not selected by the player (i.e. the $h_{xy'}$ values of all the grid locations selected by the player).

The structure of the game database 212 in this embodiment is shown in FIG. 13*b*. Each entry in the game database has a game identification number 901, a customer identification number 702 and the winning grid locations 903, as in the previous embodiments. The entry also has the user-selected grid location 902, the denomination 713 of the game, the hash value 1101 for all grid locations, and the aggregate hash value 1301.

Figure 14A:
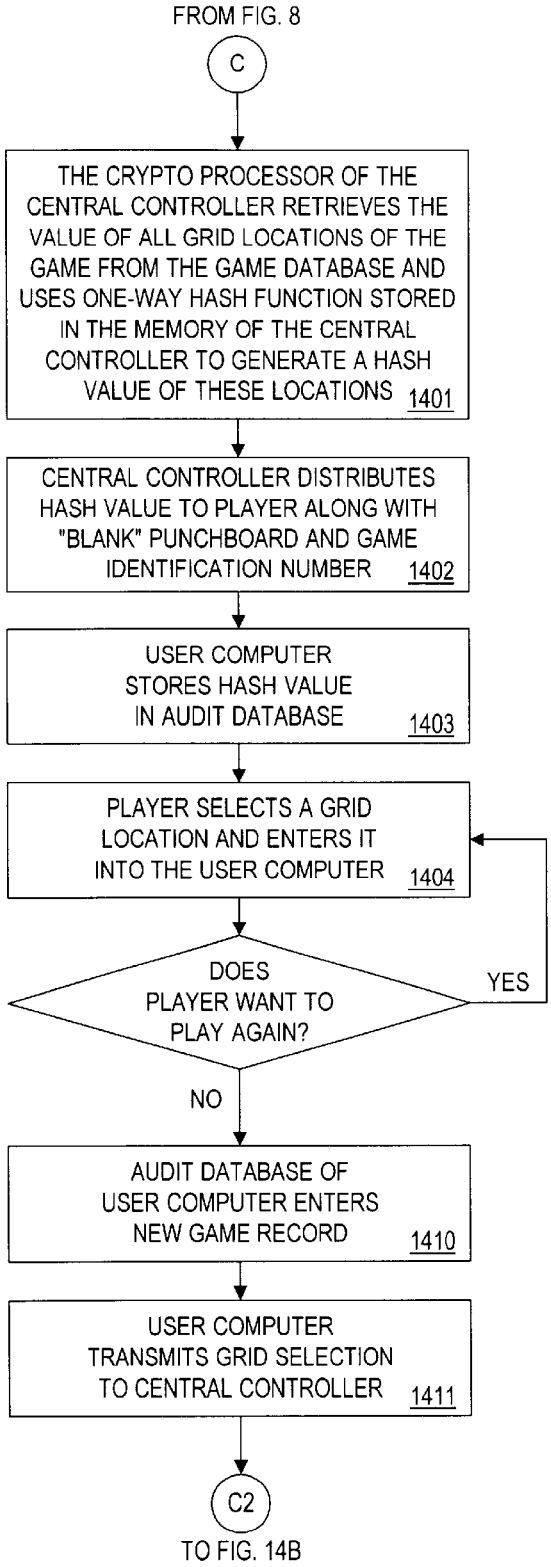
FIGS. 14*a*, 14*b* and 14*c* are connected flowcharts describing the flow of play between the user computer and the central controller according to the third embodiment of the invention.
Figure 14B:
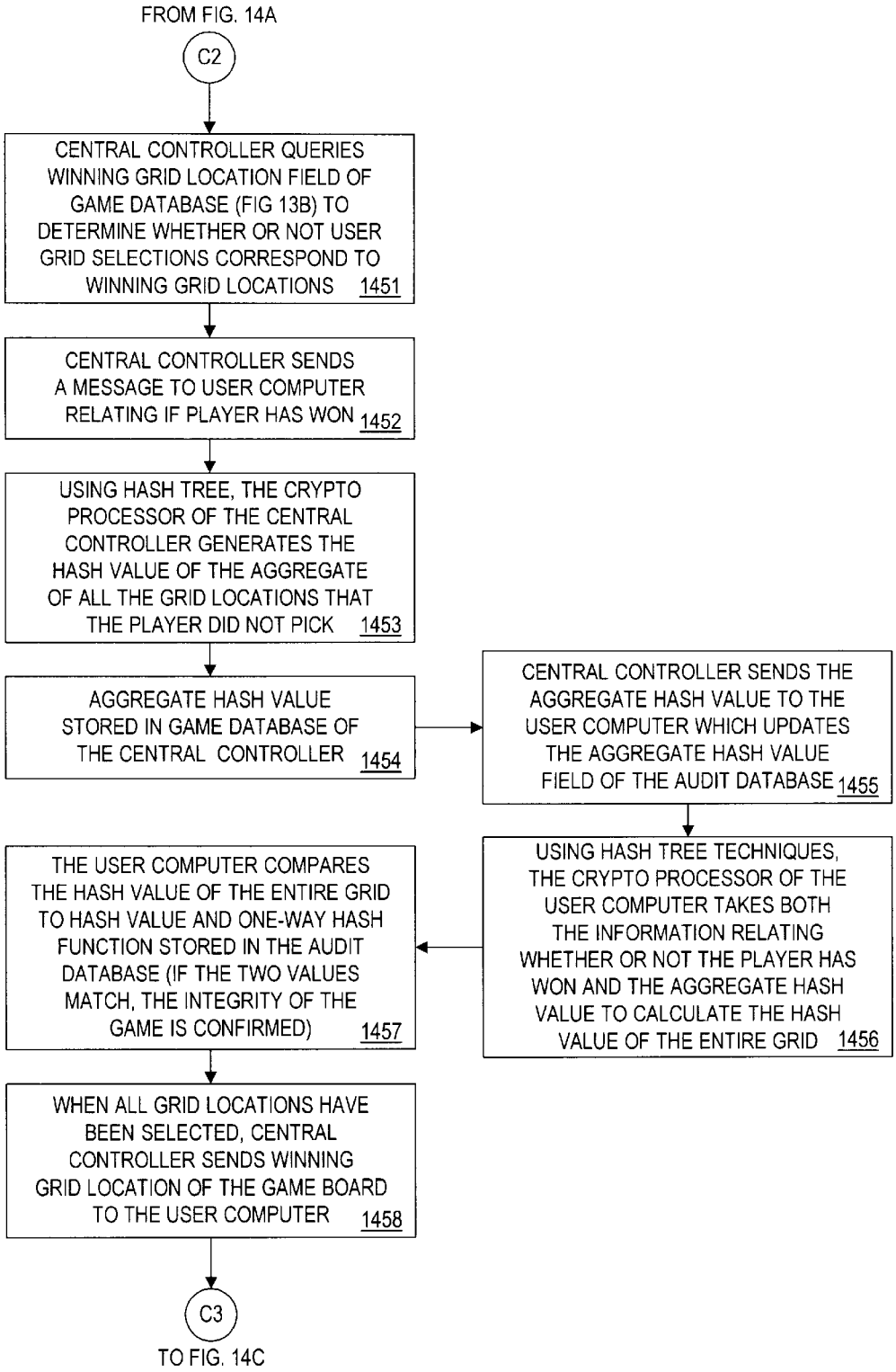
Figure 14C:
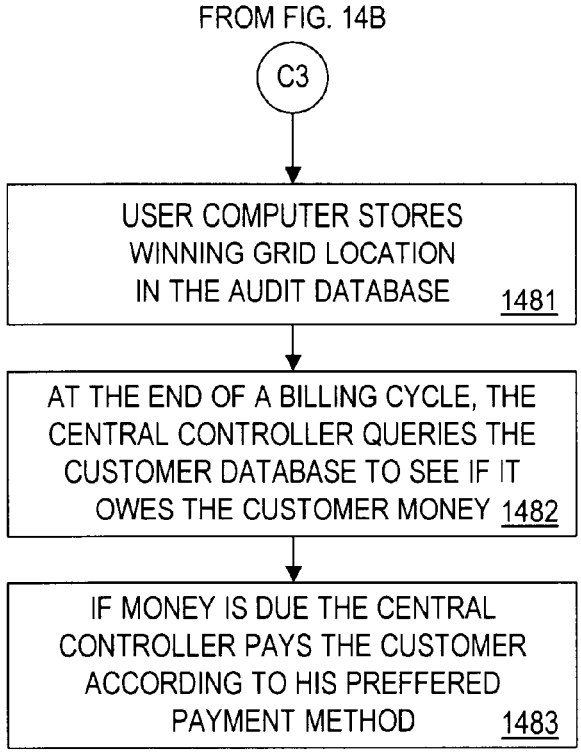

A game conducted according to the third embodiment of the invention begins with the steps shown in the flowchart of FIG. 8 as already described above, and continues with the steps shown in the flowcharts of FIGS. 14*a*, 14*b* and 14*c*.

In step 1401, the cryptoprocessor 202 of the central controller 101 retrieves the value of all grid locations of the game from the game database 212, and uses one-way hash function H stored in the memory (RAM 204 or ROM 205) of the central controller to hash these grid locations, thereby generating h, the hash value 1101 (i.e. the hash value of all grid locations). The central controller 101 then (step 1402) distributes the hash value 1101 to the user computer 102, along with a "blank" punchboard 500 including the game identification number 510. The user computer 102 stores the hash value 1101 in the audit database 311 (step 1403). The player selects a grid location 902 and enters it into the user computer 102, using the input device 320 (step 1404). The player may enter additional selections if he so desires. After the player has made all of the selections for that game, a new record is entered in the audit database 311 of the user computer 102, reflecting the ID number for the game and the player's selected grid locations (step 1410). The user computer 102 then transmits the player's grid selections 902 and game ID number to the central controller 101 along with the game ID number (step 1411).

The central controller then (step 1451) queries the game database 212 to obtain the winning grid locations 903, to determine whether or not the player's grid selections correspond to the winning grid locations. The central controller 101 sends a message to the user computer 102 relating whether the player has won (step 1452).

The integrity of the game is verified in steps 1453 through 1457. Using the hash tree algorithm, the cryptoprocessor 202 of the central controller 101 generates (step 1453) an aggregate hash value 1301; this value is the hash value of the aggregate of all the grid locations that the player did not pick (i.e. $h_{xy'}$). The aggregate hash value 1301 is stored in the game database 212 of the central controller (step 1454). In step 1455, the central controller 101 sends the aggregate hash value 1301 to the user computer 102, which updates the aggregate hash value field of the audit database 311.

Using hash tree techniques, the cryptoprocessor 302 of the user computer 102 takes both the information relating to the prize value corresponding to the player's selection (i.e. $h_{xy}$) and the aggregate hash value 1301 to calculate a hash value for the entire grid (step 1456). In step 1457, the user computer 102 uses hash tree techniques to compare this hash value for the entire grid to the hash value 1101 stored in the audit database 311. If the two values match, the integrity of the game is confirmed.

At this point, the player does not know the location of any winning locations on the grid, and therefore cannot help any other player to win. The winning grid locations are not revealed until all players have made all of their selections.

When all grid locations have been selected by all the players, the central controller 101 sends the winning grid locations to the user computer 102 (step 1458). The user computer stores the winning grid locations in the audit database 311 (step 1481). At the end of a billing cycle, the central controller 101 queries the customer database 211 to see if the customer is owed money (step 1482). If money is due the customer, the central controller 101 initiates a payment to the customer according to the customer's preferred payment method 709 (step 1483).

Fourth Embodiment (Central Controller Encryption)

In the fourth embodiment of the invention, the audit database 311 in the user computer 102 has a structure as shown in FIG. 15*a*. As in the previous embodiments, each record in the audit database corresponds to one game. A record includes the game identification number 901, selected grid location or locations 902, and the game denomination 713. In this embodiment, the record also includes a random key 1510, and encrypted and decrypted versions (1520 and 1530 respectively) of the winning grid locations.

The structure of the game database 212 in this embodiment is shown in FIG. 15*b*. Each entry in the game database has a game identification number 901, a customer identification number 702 and the winning grid locations 903, as in the previous embodiments. The entry also has the user-selected grid location 902, the game denomination 713 and the random key 1510.

Figure 16:
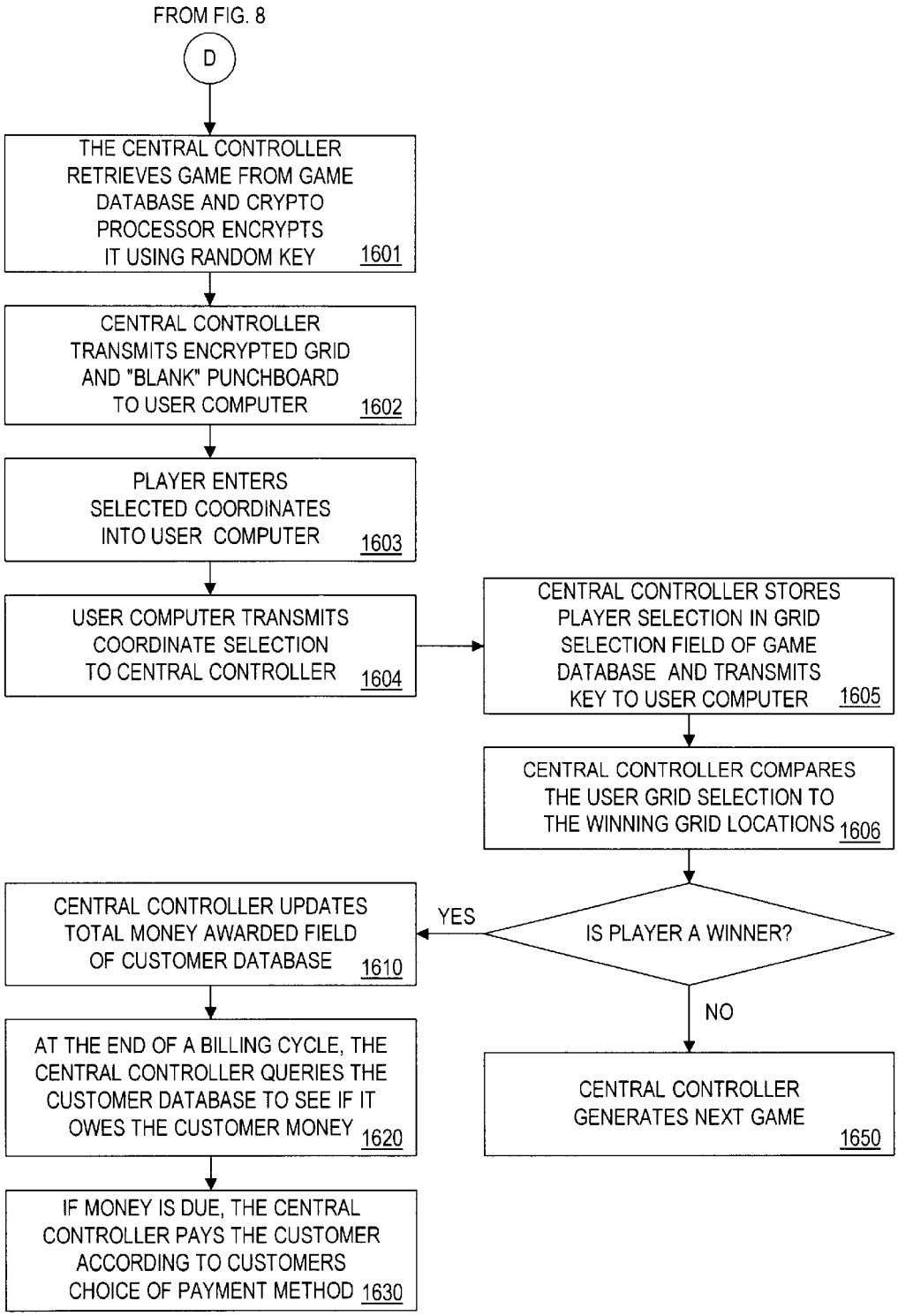
FIG. 16 is a flowchart describing the flow of play between the user computer and the central controller according to the fourth embodiment of the invention.

A game conducted according to the fourth embodiment of the invention begins with the steps shown in the flowchart of FIG. 8 as already described above, and continues with the steps shown in the flowchart of FIG. 16.

In step 1601, the central controller 101 retrieves the winning grid locations 903 for a game from the game database 212; the cryptoprocessor 202 encrypts these locations using the random key 1510. The central controller 101 then transmits the encrypted grid locations to the user computer 102 along with the "blank" electronic game board (step 1602). The player enters his grid location selections into the user computer 102, using the input device 320 (step 1603). The user computer 102 transmits the player's grid location selection to the central controller along with the game ID number (step 1604). In step 1605, the central controller stores the player's selections in the selected grid locations field 902 of the game database 212, and then transmits the key 1510 to the user computer 102. The central controller 101 then (step 1606) compares the user selected grid locations 902 with the winning grid locations 903.

If the player is not a winner, the central controller proceeds to generate the next game (step 1650). If the player is a winner, the central controller 101 updates the total money awarded 707 in the customer database 211 to reflect the amount the player has just won (step 1610). In addition, at the end of a billing cycle, the central controller 101 queries the customer database 211 to see if the customer is owed money (step 1620). If money is due the player, the central controller 101 initiates a payment to the customer according to customer's payment method preference 709 (step 1630).

It should be noted that a key element of this embodiment is that the central controller 101 sends the winning grid locations to the user computer 102 (though encrypted and thus unreadable by the user computer) before receiving the user's grid location selection. The player is thereby assured that the game provider cannot change the winning locations based upon knowledge of his selection. On the other hand, the central controller holds the player's selection before the player is provided with the key to decrypt the winning locations. The encryption of the winning locations thus assures both parties that the game has been fairly conducted.

This embodiment is particularly applicable to games such as blackjack, in which the central controller could randomly arrange an electronic deck of cards, encrypt them, and transmit them to the player. The player then sends card selections and play decisions to the central controller.

Fifth Embodiment (Trusted Third Party)

In the fifth embodiment of the invention, a trusted third party computer 400 is used to assure the integrity of the game. The audit database 311 in the user computer 102, the audit database 411 in the trusted third party computer 400 (both shown in FIG. 17*a*) and the game database 212 in the central controller 212 (shown in FIG. 17*b*) have the same structure. Each record in these databases corresponds to one game. A record includes the game identification number 901, selected grid location or locations 902, the winning grid locations 903, the game denomination 713 and the customer identification number 702.

Figure 18A:
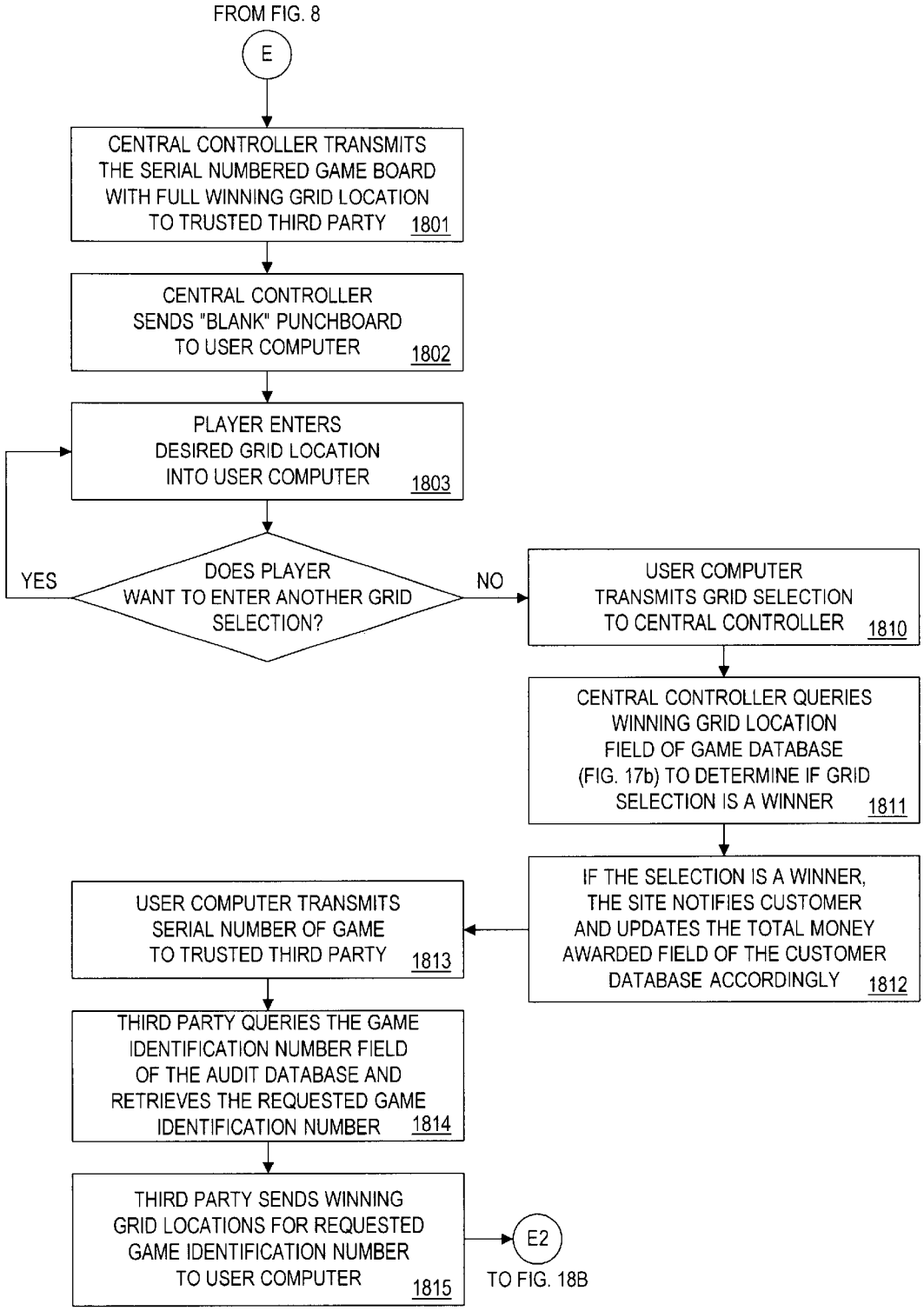
FIGS. 18*a* and 18*b* are connected flowcharts describing the flow of play between the user computer, the central controller, and the third party computer according to the fifth embodiment of the invention.
Figure 18B:
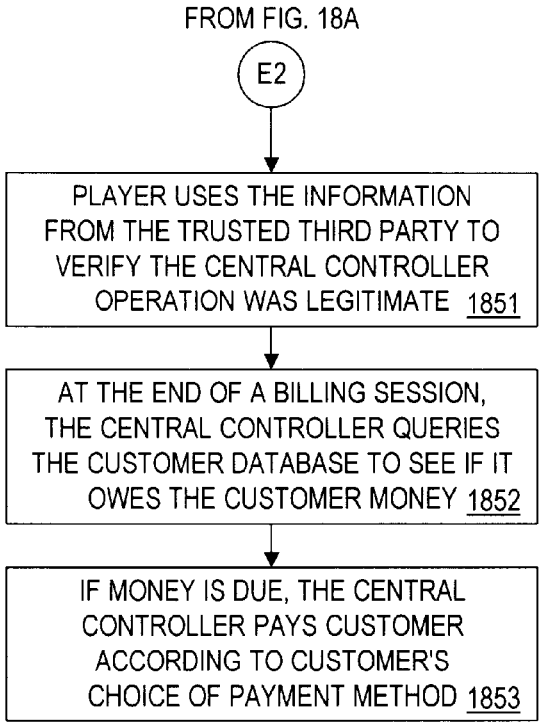

A game conducted according to the fifth embodiment of the invention begins with the steps shown in the flowchart of FIG. 8 as already described above, and continues with the steps shown in the flowcharts of FIGS. 18*a* and 18*b*. In step 1801, the central controller 101 transmits the game identification number 901 and the winning grid locations 903 to the trusted third party 400. The central controller 101 then sends a "blank" punchboard 500 to the user computer 102 (step 1802). The player selects a grid location 902 and enters it into the user computer 102, using the input device 320 (step 1803). The player may enter additional selections if he so desires. After the player has made all of the selections for that game, the user computer 102 transmits the player's grid selections 902 to the central controller 101 (step 1810). The central controller queries the winning grid location field 903 of the game database 212 to determine if the player's grid selection is a winner (step 1811). If the selection is a winner (step 1812), the controller notifies the player and updates the total money awarded field 707 of the customer database 211 accordingly.

The user computer 102 then transmits the game identification number to the trusted third party 400 (step 1813). The CPU 401 of the third party computer 400 queries the game identification number field 901 of the audit database 411 and retrieves the requested game identification number (step 1814). The third party computer 400 then sends the winning grid locations corresponding to the requested game identification number to the user computer 102 (step 1815).

In step 1851, the player uses the information from the trusted third party 400 to verify that the game provided by the central controller 101 was legitimate. In this embodiment, the use of the trusted third party makes encryption of player selected grid locations and winning grid locations unnecessary.

At the end of a billing cycle, the central controller 101 queries the customer database 211 to see if the customer is owed money (step 1852). If money is due the player, the central controller 101 initiates a payment to the customer according to customer's payment method preference 709 (step 1853).

Many variations of the embodiments discussed above are possible. For example, the central controller can track the amount of play engaged in by individual users for marketing purposes. In particular, special advertisements could be transmitted over the Internet targeted to high volume players. The central controller may offer demonstration games for new users so that they learn how to play. The game may be configured as a "pulltab" game, rather than punchboard. A user may be offered discounts on subsequent game, to provide him with an incentive to play again.

Although the above embodiments have been described with reference to a remote player making payments by credit card, a number of payment methods are possible. For example, the player may maintain an account with the game provider, or make payments with digital cash. Furthermore, rather than interact remotely with the central controller, the player may make his payment to a live cashier, who then enters the amount of credit into the central controller using an input device.

In addition, although the above embodiments have been described with reference to communication over the Internet, it will be appreciated that the practice of our invention is not limited to Internet communications, but is applicable to a variety of possible modes of communication between the game provider and the player. Commercial online services such as CompuServe and America Online could implememt the systems and methods of the present invention.

Each of the above-described embodiments of the virtual punchboard is generally applicable to a game in which a player predicts a random outcome. One skilled in the art will appreciate how the various aspects of the virtual punchboard may be implemented in other games of chance (roulette, bingo, slot machines, blackjack, craps, lottery, etc.).

While the present invention has been described above in terms of specific embodiments, it is to be understood that the invention is not limited to the disclosed embodiments. On the contrary, the present invention is intended to cover various modifications and equivalent structures included within the spirit and scope of the appended claims.

We claim:

1. A method, comprising:

receiving an encoded player selection for a slot machine game;

transmitting a winning selection;

receiving a decoding key after the winning selection is transmitted; and determining a result based on the winning selection and the player selection.

2. The method of claim 1, wherein the player selection represents a possible reel combination for the slot machine game and wherein the winning selection represents a winning reel combination.

3. The method of claim 2, wherein the encoded player selection is encoded using a hash function.

4. The method of claim 2, wherein the encoded player selection is encoded using a hash tree function.

5. The method of claim 2, further comprising randomly generating the winning reel combination.

6. The method of claim 2, wherein at least one of the receiving and transmitting acts are performed via a communication network.

7. The method of claim 2, further comprising arranging for a player to receive payment of a prize based on the result.

8. A method, comprising:

transmitting an encoded winning selection for a slot machine game;

receiving a player selection;

transmitting a decoding key after the player selection is received; and determining a result based on the winning selection and the player selection.

9. The method of claim 8, wherein the player selection represents a possible reel combination for the slot machine game and wherein the winning selection represents a winning reel combination.

10. The method of claim 9, wherein the encoded winning reel combination is encoded using a hash function.

11. The method of claim 9, wherein the encoded winning reel combination is encoded using a hash tree function.

12. The method of claim 9, further comprising randomly generating the winning reel combination.

13. The method of claim 9, wherein at least one of the receiving and transmitting acts are performed via a communication network.

14. The method of claim 9, further comprising arranging for a player to receive payment of a prize based on the result.

15. A method of generating and verifying a result of a computer-based slot machine game, the method comprising:

receiving from a player computer a player selection representing a possible reel combination for the slot machine game;

transmitting to the player computer a winning reel combination;

determining a result as to whether the player has won based on the winning reel combination and the player selection; and verifying the result by determining that the winning reel combination and the player selection were independently generated.

16. The method of claim 15, wherein the player selection is encoded.

17. The method of claim 16, further comprising receiving a decoding key after the winning reel combination is transmitted.

18. The method of claim 15, wherein the winning reel combination is encoded.

19. The method of claim 18, further comprising transmitting a decoding key after the player selection is received.

20. The method of claim 15, further comprising randomly generating the winning reel combination.

21. The method of claim 15, wherein at least one of the receiving and transmitting acts are performed via a communication network.

22. The method of claim 15, further comprising arranging for the player to receive payment of a prize based on the result.

23. An apparatus, comprising:

a processor; and a storage device in communication with the processor and storing instructions adapted to be executed by the processor to:

receive an encoded player selection for a slot machine game;

transmit a winning selection;

receive a decoding key after the winning selection is transmitted; and determine a result based on the winning selection and the player selection.

24. An apparatus, comprising:

a processor; and a storage device in communication with the processor and storing instructions adapted to be executed by the processor to:

transmit an encoded winning selection for a slot machine game;

receive a player selection;

transmit a decoding key after the player selection is received; and determine a result based on the winning selection and the player selection.

25. An apparatus for generating and verifying a result of a computer-based slot machine game, comprising:

a processor; and a storage device in communication with the processor and storing instructions adapted to be executed by the processor to:

receive from a player computer a player selection representing a possible reel combination for the slot machine game;

transmit to the player computer a winning reel combination;

determine a result as to whether the player has won based on the winning reel combination and the player selection; and verify the result by determining that the winning reel combination and the player selection were independently generated.

* * * * *